United States Patent [19]

Getgey et al.

[11] Patent Number: 4,662,856

[45] Date of Patent: May 5, 1987

[54] ANIMATED TOY

[76] Inventors: William F. Getgey, 2191 Victory Pkwy., Cincinnati, Ohio 45206; Rudolph D. Vap, 5861 Donjoy Dr., Cincinnati, Ohio 45242

[21] Appl. No.: 804,345

[22] Filed: Dec. 3, 1985

[51] Int. Cl.[4] ..... A63H 17/25; A63H 11/10

[52] U.S. Cl. ..... 446/280; 446/289; 446/337

[58] Field of Search ..... 446/280, 288, 289, 279, 446/292, 284, 275, 287, 272, 274, 269, 270, 282, 285, 293, 427, 448, 337

[56] References Cited

U.S. PATENT DOCUMENTS

| | | | |
|---|---|---|---|
| 788,110 | 4/1905 | Lehmann | 446/287 |
| 902,429 | 10/1908 | Miners | 446/288 |
| 4,192,093 | 3/1980 | Hamano | 446/427 |

FOREIGN PATENT DOCUMENTS

| | | | |
|---|---|---|---|
| 125130 | 11/1901 | Austria | 446/280 |

*Primary Examiner*—Mickey Yu

*Attorney, Agent, or Firm*—Wood, Herron & Evans

[57] ABSTRACT

An animated toy which comprises a rigid hollow base over the open top of which there is a flexible sheet of plush fabric material. Rotatably mounted in the base there is a wheel, the bottom of which extends beneath the bottom surface of the base. A cam interconnects the wheel with the underside of the plush fabric covering such that movement of the toy over a surface effects expansion and contraction of the plush fabric cover. On the exterior surface of the plush fabric cover there are animal characteristics, such as nose and eyes, so that the impression created by the expansion and contraction of the cover is one of a living, breathing animal.

17 Claims, 6 Drawing Figures

ANIMATED TOY

This invention relates to toys and more particularly, to "plush" toys.

"Plush" toys are those which are covered with a fabric which is impregnated on one side with long, soft fibers. These fibers are often one inch or more in length and very dense over the surface of the fabric. Consequently, plush fabric covered toys have a very soft feel. As a result of this soft or cuddly feel, such toys are very popular as humanoid or animal dolls.

In general, plush covered toys are static and have no moving parts or animated characteristics. It has therefore been one objective of this invention to provide a plush toy which has more personality and more appeal than that which can be created with a static toy.

Still another objective of this invention has been to create an animated toy which has the appearance of being alive because of the moving parts and the specific nature of the movement of those parts. To create this appearance, the animated toy of this invention has an expansible, contractible movement which gives the impression of a living, breathing animal.

Yet another object of this invention has been to provide an animated plush toy having a very simple mechanism contained therein for effecting movement of the animated portions of the toy. Thereby, the toy may be made very cost effective or very inexpensively while still creating a very durable animated toy.

These objectives are achieved and one aspect of this invention is predicated upon the concept of trapping a plush fabric material between two hard or rigid bodies, one of which is movable relative to the other so as to create the effect of a live movable character, and particularly, to create the effect of a character which lives and breathes as a consequence of the expansible, contractible nature of the movement imparted to the plush fabric material by the hard movable second part of the toy.

The invention of this application which accomplishes these objectives comprises an animated toy having a rigid hollow base within which there is a rotatable wheel. Over the open top of this base and fixedly secured to it there is a plush fabric material cover, the exterior surface of which has fibers extending therefrom. To the inside surface of this plush material, there is affixed a rigid plate. A cam extends between the wheel and the plate such that rotation of the wheel effects reciprocating movement of the plate and thereby, expansion and contraction of the plush fabric covering material. Animal characteristics or features, such as a nose and eyes, protrude from the top surface of the plush fabric and are attached to the cam plate so that upon rotation of the wheel, the plush material not only is caused to move up and down, but the animal characteristics move up and down with it. Thereby, the impression is created that the toy is alive and breathing as a consequence of rotation of the wheel contained internally of the rigid base. In the preferred embodiment, the wheel extends beneath the bottom surface of the rigid base of the toy so that it may be rotated by either moving the toy over a flat surface, such as a table top, or causing it to be rotated by movement of another toy, such as a toy vehicle, within which the animated plush toy is situated.

The primary advantage of this invention is that it creates a "plush" toy with personality and one which has more appeal than a conventional static doll. It has the appearance of being alive. This plush toy also has the advantage of being very cost effective. It is very inexpensive to produce because of the simplicity of the mechanism which effects the movement of the toy parts. It is also very durable because of that same simplicity.

These and other objects and advantages of this invention will be more readily apparent from the drawings in which.

Figure 1:
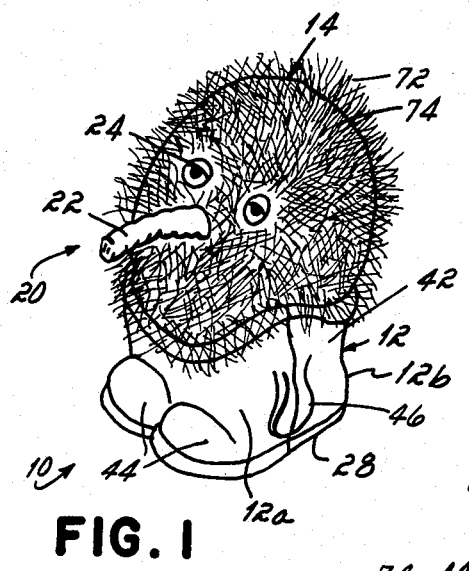
FIG. 1 is a perspective view of an animated toy incorporating the invention of this application.
Figure 2:
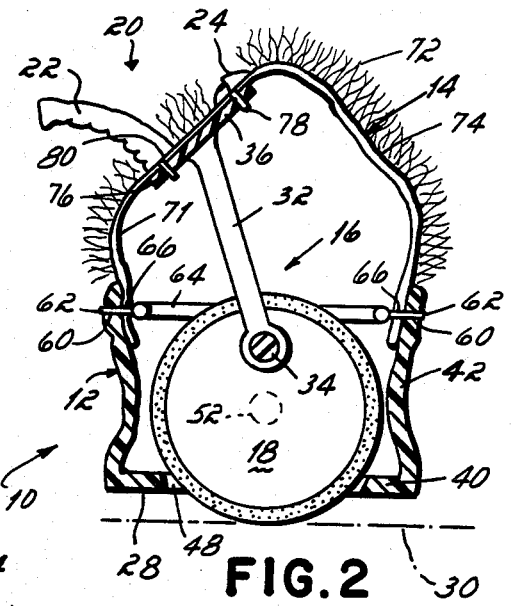
FIG. 2 is a cross-sectional view through the animated toy of FIG. 1.
Figure 3:
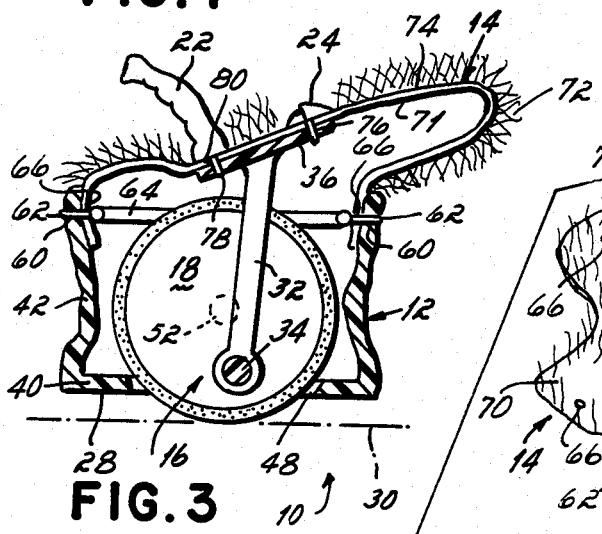
FIG. 3 is a view similar to FIG. 2 but illustrating the toy in a position where the cover is reciprocated by the wheels.

Referring first to FIGS. 1 through 4, it will be seen that the animated toy 10 of this invention comprises a hollow rigid base 12 over the open top of which there is affixed a plush fabric cover or top 14. Internally of the base there is a cam mechanism 16, including a pair of rotary drive wheels 18 for effecting movement of the plush fabric cover or top 14. Affixed to the top or exterior of the plush fabric cover there are animal features 20. In the preferred embodiment, these animal features comprise an animal nose or trunk 22 and a pair of eyes 24.

The bottom portions of the drive wheels 18 of the cam mechanism 16 extend below the bottom surface 28 of the base 12 so that linear movement of the toy 10 over a planar surface 30 effects rotation of the drive wheels 18. Thereby, a cam rod 32 of the cam mechanism 16, which extends between an eccentric pin 34 on the drive wheels and a plate 36 attached to the underside of the plush fabric cover 14, is caused to reciprocate in a generally vertical plane.

In the use of the animated toy 10, the toy is manually moved over the planar surface 30 while the bottom of the wheel 18 frictionally engages that planar surface. This results in the cam mechanism 16 causing the plush fabric cover, including its attached animal features 20, to move up and down, thereby imparting to the animated toy the impression that it is a living animal which breathes or expands and contracts as it is moved over the surface 30.

Figure 4:
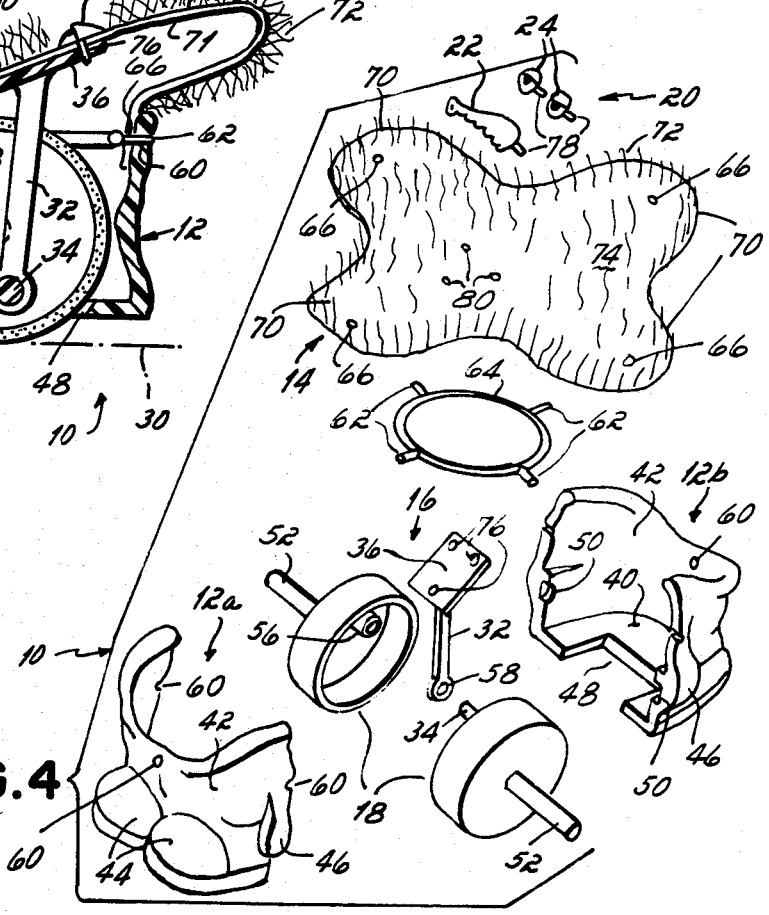
FIG. 4 is an exploded perspective view of the toy of FIG. 1.

With reference now to FIG. 4, it will be seen that the base 12 is generally hollow. It comprises a bottom wall 40, a side wall 42, and a generally open top. In the preferred embodiment, the base has feet 44 and arms 46 molded thereon for purposes of imparting a more human characteristic to the toy. In the preferred embodiment, the base 12 is molded in two pieces **12*a* and 12*b*. When assembled, these two pieces are glued or otherwise fixedly secured together to form the assembled base 12**.

The bottom 40 of the base has an opening 48 formed therein. The bottom portions of the drive wheels 18 extend through this bottom opening.

Also molded on the inside of the base 12 are recesses 50 within which the axles 52 of the wheels 18 are rotatably received. These axles are molded onto and therefore rigidly secured to the wheels 18. Extending inwardly from one of the wheels 18 there is an eccentric pin 34 and on the other wheel, there is an eccentric sleeve 56. When the wheels are assembled, the eccentric pin 34 extends through a hole 58 in one end of the cam rod 32 and is received into the sleeve 56 of the other wheel. The two wheels are spaced apart when assembled so that the cam rod 32 may extend upwardly between the two wheels while still permitting the wheels to rotate with the cam rod passing therebetween.

Also molded into the top of the base are four small holes 60. These holes are adapted to receive pins 62 extending radially from an assembly ring 64. When the toy is assembled, the pins 62 are inserted through holes 66 in the plush fabric cover 14 and into the holes 60 of the base. The pins 62 may have glue or adhesive thereon so as to permanently attach the plush fabric cover 14 to the base or alternatively, the securement of the two halves of the base together may be relied upon to maintain the ring and cover in place on the base.

Still referring to FIG. 4, it will be seen that the plush fabric cover 14 comprises a sheet of plush fabric material, which sheet is generally shaped as a rectangle having four rounded lobes 70 extending from the sides thereof. The holes 66 are located in the outer ends of each of these lobes.

The plush fabric cover 14 has one side 71 which is generally smooth and not covered with fibers and an opposite or outer side 74 from which the long fibers 72 extend. In the preferred embodiment, these fibers are often one inch or more in length and are very dense over the surface of the fabric. Consequently, the nose 22 and eyes 24 are just visible through the long fibers.

The underside 71 of the plush fabric cover 14 is attached to the cam rod 32 by means of the plate 36 formed on the outer end of the cam rod. This plate is generally rectangular and has three small holes 76 formed therein. These holes are adapted to receive pins 78 which extend through holes 80 in the fabric and are glued or otherwise fixedly secured within the holes 76 in the plate 36.

The toy is assembled by locating the axles 52 of the wheels 18 within the recesses 50 of the base 12. The cam rod 32 is assembled with the bore in one end over the eccentric pin 34 of the wheels and with the opposite end attached to the underside 71 of the plush fabric cover 14. The outer edge of the plush fabric cover is fixedly secured to the base 12 over the open top of the base 12 by the assembly ring 64. This attachment is effected by passing the radial pins 62 of the ring through the holes 66 in the outer edges of the cover so as to sandwich the fabric cover between the ring and the inner surface of the base 12.

When the assembled toy is rolled over a planar surface 30, it has the appearance of a living and breathing animal as a consequence of the expansion and contraction of the plush fabric cover and the movement of the animal features 20.

Figure 5:
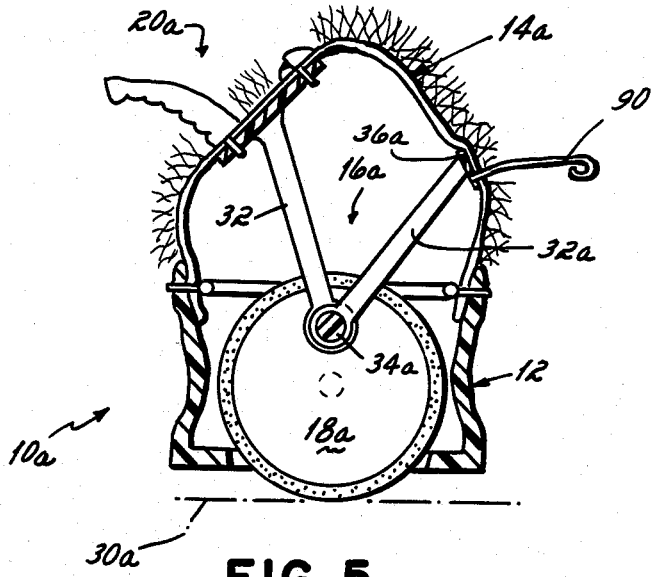
FIG. 5 is a cross-sectional view through a second modification of the toy of FIG. 1.

With reference now to FIG. 5, there is illustrated a second modification 10*a* of the toy of FIG. 1. This modification is identical to the toy of FIG. 1 except that it includes a second cam rod 32*a* having a rigid plate 36*a* formed thereon. This plate 36*a* of the cam rod 32*a* has another animal characteristic, as for example, a tail 90 attached thereto and extending from the outer side of the plush fabric cover 14*a*. In all other respects, the second modification 10*a* of animated toy is identical to the animated toy 10 of FIGS. 1 through 4. The only difference in operation of the two modifications is that in this second modification, the front and the rear of the toy tend to expand and contract in synchronization, and the nose 20*a* and tail 90 both have movement imparted to them as a consequence of the wheel 18*a* being rolled over a flat planar surface 30*a*.

Figure 6:
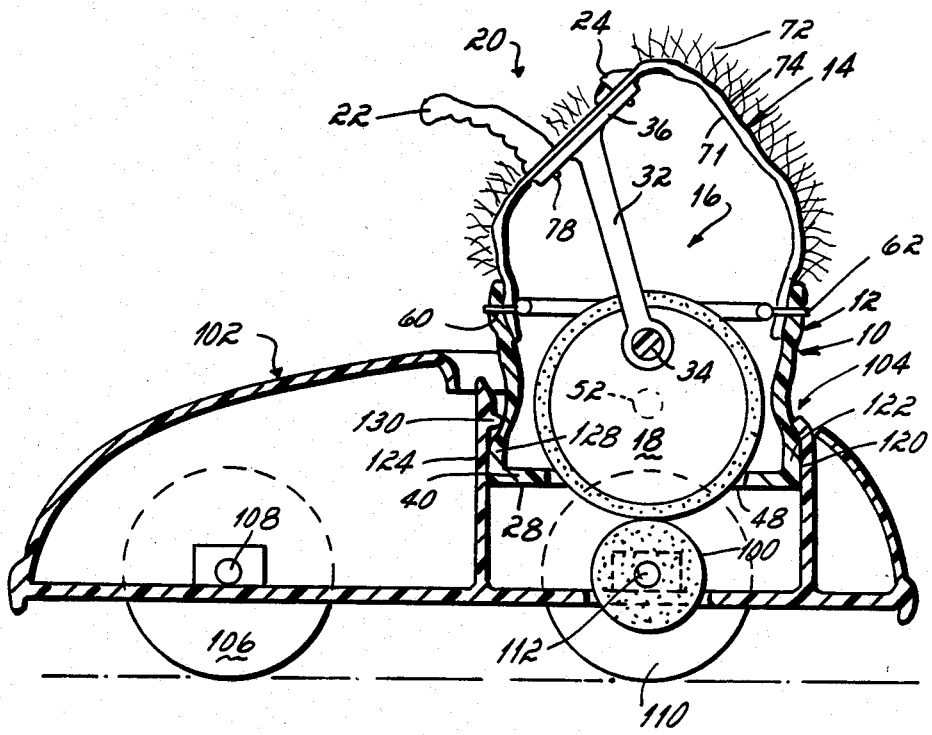
FIG. 6 is a cross-sectional view of the toy of FIG. 1 located within a movable vehicle such that movement of the vehicle imparts animation to the plush toy character located within the vehicle.

With reference now to FIG. 6, there is illustrated a variation of the animal toy 10 wherein the drive wheels 18 are caused to rotate by a driven wheel 100 of a toy vehicle 102. In one preferred embodiment, the toy vehicle 102 has the configuration of a convertible automobile within the top or passenger compartment 104 of which the animated toy 10 is received. This convertible automobile toy 102 has rotatable front wheels 106 mounted upon an axle 108 and rotatable rear wheels 110 fixedly mounted upon a rear axle 112. Consequently, as the toy automobile 102 is moved over a flat planar surface, the wheels 106, 110 are caused to rotate and rotation of the rear wheels 110 effects rotation of the rear axle 112. Affixed to the rear axle 112 there is the driven resilient wheel 100, the peripheral surface of which engages the peripheral surface of the wheels 18 and thereby imparts rotation to the drive wheels 18 of the animated toy 10. Alternatively, the wheels 110 may be driven by a small drive motor so as to impart linear movement to the toy vehicle 102 and simultaneous rotational drive to the wheels 18 of the animated toy 10.

In the preferred embodiment, the animated toy 10 is retained in the open passenger compartment 104 of the toy vehicle by a detent mechanism, which mechanism is operative to maintain the peripheral surface of the wheels 18 in driving engagement with the peripheral surface of the driven wheel 100. This detent mechanism comprises a shallow recess 120 formed in the rear wall of the passenger compartment of the toy vehicle and adapted to receive a protrusion 122 on the base of the animated toy. The front wall of the passenger compartment of the toy vehicle is upstanding from the base of the toy vehicle and is flexible at the top such that the upper end of the front wall 124 may be flexed or pushed forwardly so as to enable a protrusion 128 on the base 12 of the toy 10 to move over a detent 130 on the upper end of the wall 124. After the protrusion 124 has passed beyond the detent 130, the natural resiliency of the front wall 124 springs that wall backwardly over the protrusion 128 so as to secure the animated toy 10 within the passenger compartment of the toy vehicle 102. The animated toy, though, may be lifted from the passenger compartment by simply overcoming the spring bias of the front wall 124 of the toy vehicle 102 and lifting it upwardly. Consequently, the animated toy 10 may be utilized either as a passenger in the toy vehicle 102 in which event its drive wheel 18 is driven by the wheels 110 of the toy vehicle and the attached driven roller 100, or the animated toy 10 may be removed from the vehicle and simply moved over a flat planar surface 30 to effect animated action of the toy.

While we have described only two preferred embodiments of our invention, persons skilled in this art will appreciate numerous changes and modifications which may be made without departing from the spirit of our invention. Therefore, we do not intend to be limited except by the scope of the following appended claims:

We claim:

1. An animated toy comprising a rigid base having a rotatable wheel mounted therein for rotation about a horizontal axis, said wheel having a portion extending below a bottom surface of said base, said rigid base having an upstanding peripheral side wall, said side wall having an upper edge, a flexible sheet of material secured to said rigid base, said sheet of material having an outer peripheral edge, said outer peripheral edge of said sheet of material being fixedly secured to said upper edge of said side wall of said base, cam means including a cam rod extending between an eccentric pivot post on said rotatable wheel and said flexible sheet of material, one end of said cam rod being secured to said eccentric pivot post of the wheel and the other end being secured to said sheet of material so that rotary movement of said wheel imparted by moving said base over a stationary supporting surface effects reciprocating expansible and contractable movement of said sheet of material.

2. The animated toy of claim 1 which further includes animal features secured to said sheet of material adjacent the point of attachment of said sheet of material to said other end of said cam rod.

3. The animated toy of claim 2 wherein said animal features are fixedly secured to said other end of said cam rod and said sheet of material.

4. The animated toy of claim 2 wherein said animal features are visible from one side of said sheet of material and said other side of said sheet of material is fixed to said other end of said cam rod.

5. The animated toy of claim 1 in which said sheet of material comprises a plush fabric material having long fibers extending from one side of said sheet, the opposite side of said sheet being attached to said other end of said cam rod.

6. An animated plush toy comprising a rigid base having a bottom surface and a wheel rotatably mounted therein, said wheel being rotatable about a horizontal axis and having a portion extending below the bottom surface of said base, said rigid base having an upstanding peripheral side wall having an upper edge, a flexible sheet of plush fabric material extending over the top of said base, the periphery of said sheet of fabric material being secured to the upper edge of said side wall of said base, the top surface of said sheet of material having long fibers extending therefrom, animal features secured to and protruding from said top surface of said fabric material, and cam rod means extending between an eccentric pivot post on said wheel and said sheet of fabric material such that rotation of said wheel resulting from movement of said base over a stationary supporting surface effects reciprocating expansible and contractable movement of said sheet of fabric material, thereby creating the impression of a movable breathing animated toy.

7. The animated toy of claim 6 wherein said cam means includes a fixed plate secured to the underside of said sheet of fabric material, said animal features being secured to said fixed plate.

8. The animated toy of claim 6 wherein said rigid base is generally hollow and has an open top, said fabric material extending over the open top of said hollow base.

9. In combination, an animated toy and a toy vehicle for imparting animation to said toy, said animated toy comprising a rigid base having a rotatable wheel mounted therein, a flexible sheet of material secured to said rigid base, cam means including a cam rod extending between said rotatable wheel and said flexible sheet of material, one end of said cam rod being secured to said wheel and the other end being secured to said sheet of material so that rotation of said wheel effects reciprocating movement of said sheet of material, said toy vehicle comprising a vehicle body having rotatable wheels mounted upon the underside thereof, an animated toy receiving compartment in said vehicle body, said animated toy being receivable within said toy receiving compartment, and drive means extending between said wheels of said toy vehicle and said wheel of said animated toy when received within said receiving compartment of said toy vehicle such that rotation of said wheels of said toy vehicle is operative to effect driving rotation of said wheel of said animated toy received in said toy receiving compartment of said vehicle.

10. The combination of claim 9 wherein said animated toy further includes animal features secured to said sheet of material adjacent the point of attachment of said sheet of material to said other end of said cam rod.

11. The combination of claim 10 wherein said animal features are fixedly secured to said other end of said cam rod and said sheet of material.

12. The combination of claim 10 wherein said animal features are visible from one side of said sheet of material and said other side of said sheet of material is fixed to said other end of said cam rod.

13. The combination of claim 9 wherein said sheet of material of said animated toy comprises a plush fabric material having long fibers extending from one side of said sheet, the opposite side of said sheet being attached to said other end of said cam rod.

14. In combination, an animated plush toy and a toy vehicle, said animated plush toy comprising a rigid base having a wheel rotatably mounted therein, said wheel being rotatable about a horizontal axis and having a portion extending below the bottom surface of said base, a flexible sheet of plush fabric material extending over the top of said base, the periphery of said sheet of fabric material being secured to said base, the top surface of said sheet of material having long fibers extending therefrom, animal features secured to and protruding from said top surface of said fabric material, and cam means extending between said wheel and said sheet of fabric material such that rotation of said wheel effects reciprocating movement of said sheet of fabric material, thereby creating the impression of a movable breathing animated toy, said toy vehicle comprising a vehicle body having rotatable wheels mounted upon the underside thereof, a toy passenger compartment in said vehicle body, said animated plush toy being located within said passenger compartment, drive means extending between said wheels of said toy vehicle and said wheel of said animated plush toy such that rotation of said wheels of said vehicle effects simultaneous reciprocating movement of said sheet of fabric material of said animated plush toy.

15. The combination of claim 14 wherein said cam means of said animated plush toy includes a fixed plate secured to the underside of said sheet of fabric material, said animal features being secured to said fixed plate.

16. The combination of claim 14 wherein said rigid base of said animated plush toy is generally hollow and has an open top, said fabric material extending over the open top of said hollow base.

17. The combination of claim 16 wherein said base of said animated plush toy has a bottom surface and the lower portion of said wheel extends beneath said bottom surface of said base so as to enable said toy to be moved over a flat surface so as to impart rotation to said wheel.

* * * * *